United States Patent [19]

Chiba et al.

[11] 4,220,910

[45] Sep. 2, 1980

[54] RAISING-PRESSURE DELAY TYPE ELECTROMAGNETIC PUMPS

[75] Inventors: Yasutsune Chiba; Shizuo Arima; Shoji Suzuki; Masayuki Saitoh, all of Tokyo, Japan

[73] Assignee: Taisan Industrial Co., Ltd., Tokyo, Japan

[21] Appl. No.: 866,043

[22] Filed: Dec. 30, 1977

[30] Foreign Application Priority Data

Jul. 21, 1977 [JP] Japan ..... 52/96494[U]

[51] Int. Cl.[2] ..... H05B 39/02

[52] U.S. Cl. ..... 323/19; 315/194; 307/252 N

[58] Field of Search ..... 307/252 N; 323/225 C, 323/34–40, 18; 315/194, 205

[56] References Cited

U.S. PATENT DOCUMENTS

| | | | |
|---|---|---|---|
| 3,267,337 | 8/1966 | Doyle et al. | 307/252 N |
| 3,466,529 | 9/1969 | Grafham | 315/194 |
| 3,495,154 | 2/1970 | Dosch et al. | 323/36 |
| 3,498,848 | 2/1970 | Galloway | 323/36 |
| 3,543,141 | 11/1970 | Lawson | 323/36 |
| 3,612,945 | 10/1971 | Stevens | 315/205 |
| 3,742,255 | 6/1973 | Stevens | 315/194 |
| 3,745,382 | 7/1973 | Hoge et al. | 307/252 N X |
| 3,793,531 | 2/1974 | Ferrigno | 323/34 X |
| 3,859,591 | 1/1975 | Saunders | 323/18 |
| 4,008,416 | 2/1977 | Nakasone | 307/252 N X |

FOREIGN PATENT DOCUMENTS

| | | | |
|---|---|---|---|
| 43-4548 | 1/1968 | Japan | 323/36 |

OTHER PUBLICATIONS

*EDN/EEE* Sep. 15, 1971, pp. 42–43, "Plagued by Trial Hysteresis" by Forsberg.

*RCA Tech. Notes* RCA TN No. 715, Jun. 1967, 2 sheets, "Triggerless Phase Control Crt . . . " by Buczynski.

*Primary Examiner*—J. D. Miller

*Assistant Examiner*—L. C. Schroeder

*Attorney, Agent, or Firm*—Kane, Dalsimer, Kane, Sullivan and Kurucz

[57] ABSTRACT

An electromagnetic pump in which the ignition sound at the time of starting of a combustor is lowered by delaying a raising speed for the delivery pressure of fuel oil. The delivery pressure of fuel oil is automatically controlled by means of an electronic delay circuit including a silicon controlled rectifier which is phase controlled in synchronism with a power source, a trigger diode, and resistors and condensers used for setting the amount of time delay.

2 Claims, 4 Drawing Figures

RAISING-PRESSURE DELAY TYPE ELECTROMAGNETIC PUMPS

BACKGROUND OF THE INVENTION

This invention relates to a raising-pressure delay type electromagnetic pump, and more particularly to an electromagnetic pump in which the ignition sound at the time of starting of a combustor such as a gun-type burner is effectively lowered.

In general, in the case of a gun-type burner for a home-use or business-use heating system, a hot water supply boiler, an air heater and the like, the fuel oil ejected from a nozzle is used in atomized condition. When the fuel oil is ejected from the nozzle in the atomized condition, the quantity of the delivered fuel oil is proportional to the square root of its delivery pressure, so that the ignition at lower delivery pressures just corresponds to the one that is made at a lower quantity of the delivered fuel oil, and the ignition sound becomes naturally small. The shorter the time interval before reaching the normal delivery pressure from the starting of the pump, the larger the ignition sound since the ignition will be explosively finished, and as the result, extremely large ignition sounds are developed. Therefore, it will be understood that the ignition sound may be lowered by completing its ignition during the time interval the delivery pressure of fuel oil is low and then progressively raising it to its normal value. The ignition at lower delivery pressures is very preferable in view of safety as well as from the aspects of influence to human mind.

As will be clearly understood from the curve "a" in FIG. 1, a characteristic or raising curve of the delivery pressure for the conventional electromagnetic pump is very steep, and the normal pressure is attained for a very short time after the starting of the pump. Thus, the adjustment of the delivery pressure for obtaining an optimum timing for ignition is rather difficult, so that the advent of a gun-type burner which is adjustable in a pressure-time characteristic and also guarantees a safe ignition under a lower delivery pressure has long been anticipated.

SUMMARY OF THE INVENTION

It is therefore a primary object of the subject invention to provide an electromagnetic pump in which the ignition operation can be made safely at a low delivery pressure of fuel oil and the delivery pressure of fuel oil is optionally adjustable within a predetermined time limit with respect to the elapsed time from the starting of a pump.

A further object of the subject invention is to provide an electronic control circuit which is simple in its circuitry and compact in size and also adapted for use with the conventional electromagnetic pump coil.

The electromagnetic pump having the aforesaid objects in accordance with the present invention will be accomplished by the combination of a coil of the electromagnetic pump and an adjustable control circuit wherein a silicon controlled rectifier is turned on or off in synchronism with the waveforms of the power source, the turn-on of the SCR is phase controlled within the half-wave period of the power source, and the delaying function due to a phase control circuit is gradually made ineffective or cancelled by progressively raising the level of reference voltage at the input side of a trigger diode used for making the SCR conductive.

BRIEF DESCRIPTION OF THE DRAWINGS

The novel features of the subject invention, as well as the invention itself, and the objects and the advantages thereof will be better understood from the following description taken in conjunction with the accompanying drawings in which.

DESCRIPTION OF THE PREFERRED EMBODIMENT

Figure 1:
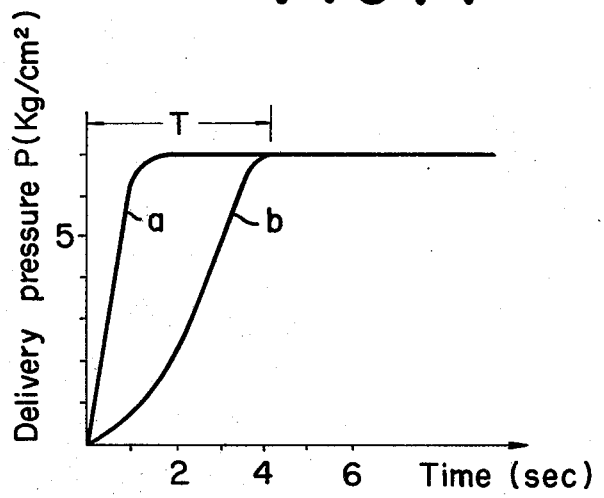
FIG. 1 shows a comparison diagram between a characteristic curve "a" for the delivery pressure of fuel oil with respect to the elapsed time from the starting of the pump, which is typically obtainable by the conventional electromagnetic pump and a characteristic curve "b" to be attained by the raising-pressure delay type electromagnetic pump in accordance with the present invention.

Referring now to FIG. 1, the characteristic curve "a" is a raising curve for the delivery pressure of fuel oil with respect to the elapsed time "t", which is representative of the conventional system not adjustable as described above. As clearly illustrated in the drawing, it rises abruptly and reaches its steady state in a very short time. On the other hand, the characteristic curve "b" shows a raising curve obtained by the raising-pressure delay type electromagnetic pump in accordance with the present invention, and the slope of which is gentle as compared with the curve "a". In addition, the time interval T before reaching its maximum delivery pressure or steady state is adjustable optionally within a predetermined time limit. Thus, the delivery pressure of fuel oil at the time of ignition can be adjusted in consideration of the performance of ignition mechanisms.

Figure 2:
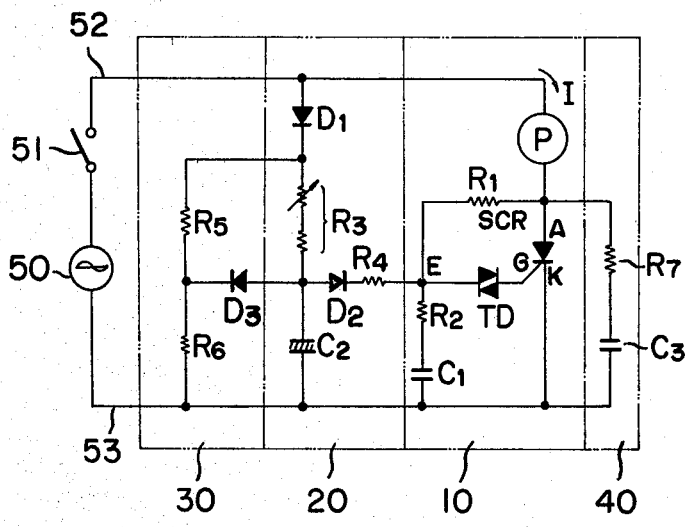
FIG. 2 shows one preferred embodiment of the electromagnetic pump in accordance with the present invention, particularly including the power source for the convenience of explanation.

Referring now to FIG. 2, the raising-pressure delay type electromagnetic pump consists of a phase control block 10, a raising-pressure control block 20, a reset block 30 and a protective circuit 40, and the power is supplied from an a-c power source 50 through a main switch 51. As illustrated in the drawing, the phase control block 10 includes a pump coil P as a load, a silicon controlled rectifier SCR whose anode A is connected to one end of the pump coil P and whose cathode K is connected to a bus bar 53 of the power source, resistors $R_1$ and $R_2$ and condenser $C_1$ all connected in series between the anode A of SCR and the bus bar 53, and a trigger diode connected between the junction of the resistors $R_1$ $R_2$ and the gate G of SCR, and provides a phase-controlled d-c current of half-wave to the pump coil P. The raising-pressure control block 20 includes a diode $D_1$, a resistor $R_3$ and an electrolytic condenser $C_2$ all connected in series between the bus bars 52 and 53 and also includes a diode $D_2$ and a resistor $R_4$ both connected in series between the junction of the resistors $R_1$ and $R_2$ in the block 10 and the junction of the resistor $R_3$ and the condenser $C_2$, and operates so as to gradually reduce the phase angle for the SCR, that is predetermined by the resistors $R_1$ and $R_2$ and the condenser $C_1$, from the instant the power is applied thereto. The reset block 30 includes resistors $R_5$ and $R_6$ connected in series from the junction of the diode $D_1$ and the resistor $R_3$ to the bus bar 53, and a diode $D_3$ connected between the junction of the resistor $R_3$ and the condenser $C_2$ in the block 20 and the junction of the resistor $R_5$ and $R_6$, and functions to discharge the electric charge storaged in the condenser $C_2$ when the power supply is once interrupted so that the raising-pressure control block 20 can operate normally upon the restoration of the power supply. Finally, the protective circuit 40 includes a resistor $R_7$ and a condenser $C_3$ connected in series between the anode A and the cathode k of SCR, and serves to protect the SCR from damaging. The function of this protective circuit is well known to those skilled in the art, a further explanation will therefore be abridged.

Figure 3:
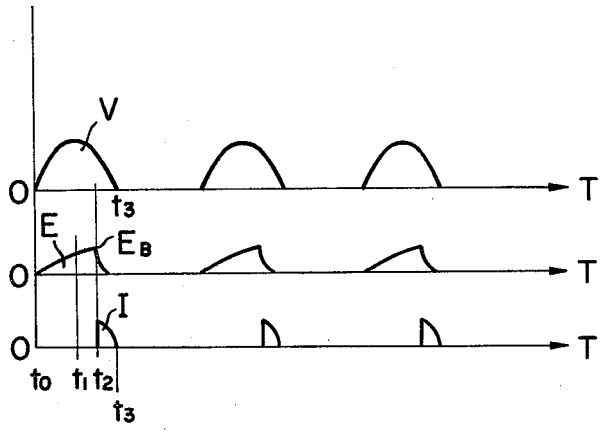
FIG. 3 shows a waveform diagram useful for explaining the operation of a phase control block.

The operation of the phase control block 10 will be now explained by referring to FIGS. 2 and 3. In FIG. 3, "V" represents the voltage between the bus bars 52 and 53, "E" represents the voltage at the point E in the block 10, and "I" represents a load current flowing through the pump coil P. Assume now that the switch 51 is turned on, the bus bar 52 is positive, and the bus bar 53 is negative. At time $t_1$, the voltage is applied to the load, but no current flows in the load since the SCR is not conducting because the voltage at the point E does not still reach a breakover voltage $E_B$ of the trigger diode TD. At time $T_2$, the voltage at the point E first becomes $E_B$ and the trigger diode TD is instantly turned on to thereby make the SCR conductive by the current flowing through the gate of SCR. At this juncture, the load current begins flowing and then stops at the time of $t_3$ or at the time of inversion of the applied voltage. The starting point of triggering the SCR is determined by the charging speed of the condenser $C_1$ through the resistors $R_1$ and $R_2$ and the breakover voltage of the trigger diode TD. Electric charge in the condenser $C_1$ is discharged through the gate K of SCR upon the conduction of the trigger diode TD and also discharged through the resistor $R_1$ during the negative period of the subsequent half-cycle to ready for the operation in the next half-cycle. In short, the current to the pump coil P flows during only the time interval $t_2$–$t_3$ and this function will be repeated in the subsequent half-cycle.

Figure 4:
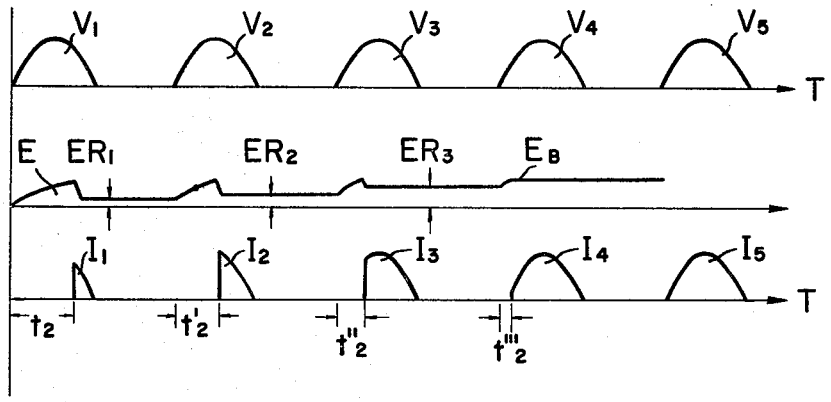
FIG. 4 shows a waveform diagram similar to FIG. 3 and useful for explaining the operation of a raising-pressure control block.

In this paragraph, the operation of the raising-pressure control block 20 will be explained by referring to FIGS. 2 and 4. In FIG. 4, "$V_1$–$V_5$" represent the voltage waveforms across the terminals of the load and show the rectified half-waves of a-c power. All the voltage waveforms are equal in amplitude and applied periodically at the same time interval. "E" represents the voltage at the point E in FIG. 2 and "$I_1$"–"$I_5$" represent load currents flowing through the pump coil P. The current $I_1$ of FIG. 4 is a load current flowing first through the pump coil P after the turn-on of the power switch 51 and equal to I in FIG. 3 in both-magnitude and firing angle. During the period of this half-cycle, the condenser $C_2$ is charged through the diode $D_1$ and the resistor $R_3$ and holds a voltage of $ER_1$ at the end of this period. Thus, in the next half-cycle, since the charging characteristic of the condenser $C_1$ remains unchanged, the time interval before reaching the $E_B$ level at the point E is shortened and the SCR is triggered at an earlier stage than before. In short, the time interval $t_2$ for the previous half-cycle is shortened to $t'_2$ as clearly observed from the drawing. As the result, the time interval allotted for the energization of the pump coil P by the load currents $I_2$ is extended accordingly, thereby increasing the driving energy to the pump coil P. In the time interval of $V_2$, the voltage $ER_2$ remains behind at the point E, so that the load current $I_3$ during the next half-cycle is, similarly, further increased. Like these, for the time interval $V_5$, the SCR will be turned on simultaneously with the application of the voltage $V_5$. Accordingly, the delivery pressure of the pump is gradually elevated after the application of power and the ratio of which can be optionally selected with the predetermined limit by adjusting the value of the resistor $R_3$. In reality, the residual voltage ER tends to drop slightly due to the reset block 30 till the starting of the next half-cycle, but the influence thereof may be neglected because it is extremely short in terms of time as compared with the time interval anticipated as reset time. The function of the reset block is to place the raising-pressure control block 20 in such a condition as it can be normally operated upon the restoration of the power supply after the interruption thereof, provided that a time interval of approximately 5 seconds are allotted before the restoration of power supply after the temporary failure thereof.

In the previous explanation, the condenser $C_1$ is assumed to be charged by way of the resistors $R_1$ $R_2$, but it will also be charged through the circuit $D_1 \rightarrow R_3 \rightarrow D_2 \rightarrow R_4 \rightarrow R_2$ when actually operated. However, for the sake of clarity, the operation was explained in disregard of this fact because the charging current through the latter circuit is very small as compared with that of the former circuit. In addition, in FIG. 4, the phase lag is assumed to be completely cancelled at the fifth half-wave, and this corresponds to 80 milliseconds in the case of a 50 Hz power supply, but such an amount of delay is presented for only explanatory purposes. In actual operation, it may be set to about 4 seconds as illustrated by the curve "b" in FIG. 4. The reset block 30 also serves as a discharge path for the condenser $C_1$ at the time of power failure.

As explained above, the raising-pressure delay type electromagnetic pump has various advantages such that the amount of delay is adjustable and it can be constructed to be small in size and light in weight since semiconductor elements are used as parts for the control circuit.

In the foregoing, a preferable embodiment of the present invention has been described. However, it should be appreciated that various modifications of such embodiment would be possible for those skilled in the art without departing from the scope and spirit of the present invention.

What is claimed is:

1. An electromagnetic pump arranged to be driven by rectified half-wave currents from a power source, comprising:

a power source;

a pump coil connected in series with said power source;

a silicon controlled rectifier connected in series with said pump coil;

a trigger diode connected to the gate of said silicon controlled rectifier;

an R-C phase control circuit connected between the anode and the cathode of said silicon controlled rectifier for controlling the firing point thereof in association with said trigger diode;

a resistor and condenser connected across the power source in series relationship to each other; and a diode means connected to the junction of said resistor and said condenser in the polarity under which current flows into said R-C phase control circuit such that the base potential of said R-C phase control circuit is raised stepwise as half-wave currents are generated from said power source.

2. An electromagnetic pump of the type to be driven by rectified half-wave currents and whose delivery pressure of fuel oil at the time of starting thereof is progressively raised, comprising:

a pump coil;

a silicon controlled rectifier connected in series with said pump coil;

a triggering circuit connected to the gate of said silicon controlled rectifier through a trigger diode for phase-controlling said silicon controlled rectifier in synchronism with the rectified half-wave currents of a power source; and a control circuit associated with said triggering circuit for gradually reducing a phase angle determined by circuit constants of said triggering circuit from the instant power is applied thereto, said control circuit including a resistor and a condenser connected in series with each other and a diode means connected to the junction of said resistor and said condenser in the polarity under which currents flow out therefrom.

* * * * *